US006112473A

United States Patent [19]

Pingel

[11] Patent Number: 6,112,473

[45] Date of Patent: Sep. 5, 2000

[54] MOLDED WALL PANEL AND HOUSE CONSTRUCTION

[75] Inventor: Nathan W. Pingel, Columbus, Ohio

[73] Assignee: PDG Domus Corporation, Columbus, Ohio

[21] Appl. No.: 09/292,863

[22] Filed: Apr. 16, 1999

Related U.S. Application Data

[62] Division of application No. 08/787,456, Jan. 22, 1997, abandoned.

[51] Int. Cl.[7] ..... E04C 1/00

[52] U.S. Cl. ..... 52/79.1; 52/79.7; 52/79.8; 52/311; 52/314; 52/481.1

[58] Field of Search ..... 52/79.1, 79.7, 52/79.8, 264, 265, 270, 481.1, 309.14, 311, 314

[56] References Cited

U.S. PATENT DOCUMENTS

| | | | |
|---|---|---|---|
| 2,375,910 | 5/1945 | Forward | 52/481.1 X |
| 2,964,800 | 12/1960 | Dorsett | 52/745.1 X |
| 3,385,743 | 5/1968 | Backberg | 52/314 X |
| 3,608,261 | 9/1971 | French et al. | 52/314 X |
| 3,621,625 | 11/1971 | Medow | 52/314 |
| 4,079,554 | 3/1978 | Twilliger | 52/314 X |
| 4,441,286 | 4/1984 | Skvaril | 52/79.1 |
| 4,513,545 | 4/1985 | Hopkins, Jr. | 52/79.1 |
| 4,644,708 | 2/1987 | Baudot et al. | 52/79.7 X |
| 4,644,719 | 2/1987 | Salazar | 52/311 |
| 4,869,036 | 9/1989 | Peacock | 52/79.1 X |
| 5,036,638 | 8/1991 | Kurtz, Jr. | 52/79.1 X |
| 5,044,134 | 9/1991 | Brockway | 52/79.1 |
| 5,813,174 | 9/1998 | Waller | 52/79.1 |
| 5,819,498 | 10/1998 | Geraci | 52/475.1 X |

*Primary Examiner*—Richard Chilcot
*Attorney, Agent, or Firm*—Standley & Gilcrest LLP

[57] ABSTRACT

A prefabricated wall and roof unit for easy and cost efficient home construction. The wall unit of the present invention is formed of a steel frame, a molded external panel formed into the shape of traditional building materials and features, and a layer of insulation material. The wall unit may be assembled in a quality controlled off-site factory.

16 Claims, 20 Drawing Sheets

MOLDED WALL PANEL AND HOUSE CONSTRUCTION

This application is a divisional of U.S. patent application Ser. No. 08/787,456 filed Jan. 22, 1997, now abandoned entitled MOLDED WALL PANEL AND HOUSE CONSTRUCTION.

BACKGROUND AND SUMMARY OF THE INVENTION

The present invention relates to a modular house construction, and, more particularly, to a molded wall panel for pre-assembled house construction.

Buying a home is one of the most significant investments a consumer can make. Home buyers want to live in a modern home with all the presently available conveniences. Unfortunately, buying a home similar to the one they grew up in, with all the "gingerbread" and detail, has become cost-prohibitive and many home buyers have to settle for homes with which they are not happy.

Past attempts have been made at decreasing the cost of home construction by prefabricating certain portions of the home off-site. However, known modular house units have failed to provide an equivalent finished home as compared to homes which are built completely on-site. Known prefabricated home units, which may have resulted in initial cost savings, are relatively simple units which do not portray any unique architectural features with respect to other units. Additionally, these known modular units are not constructed with the equivalent structural integrity and quality as traditionally built homes.

Accordingly, there is a need for prefabricated wall and roof units and house components which:

i) are modular;

ii) may be wholly constructed off-site;

iii) may have a resilient exterior which replicates the look of virtually any building material and allows for design flexibility;

iv) have injected insulation;

v) reduce maintenance requirements;

vi) allow for construction in a quality controlled environment;

vii) allow for wiring harnesses and plumbing designed into the structure; and viii) reduces the cost and time for quality home construction.

The home constructed from the modular house component of the present invention is preferably based on a framework of welded steel and a sheet steel floor deck. In the preferred embodiment a ceramic, or a resin porcelain laminated, exterior panel is attached to a steel frame. The exterior, or external, panel may be molded to replicate the look of any building material available. The interior walls are preferably dry-walled and painted. Structural insulating foam is preferably injected between the exterior and interior panels. The home constructed from the walls of the present invention may be placed on any type of traditional building foundation.

The wiring harness, plumbing and HVAC may be designed into the structure. The interior finishes are preferably typical of present housing fixtures: wood trim, cabinets, counter tops, appliances, plumbing fixtures, lighting fixtures, and floor coverings. The roof may also be made of welded structural steel and finished with a resin porcelain laminated exterior panel, molded to replicate the appropriate look of any roofing materials desired. The exterior panel of the present invention is a resilient exterior house wall which:

i) can be molded to replicate popular building materials and architectural features;

ii) is resistant to fire;

iii) maintains interior environmental temperatures better than traditional homes;

iv) is resistant to termites and other rodents;

v) can be glued to a steel house frame; and vi) which can be prefabricated in an off-site, quality controlled, environment; and vii) can be repeatedly molded from one manufactured mold.

The exterior, or external, panels are molded and attached, preferably, to steel frames off-site. The steel frames have openings for the insertion of windows and doors, or any other building fixture. The steel frames are preferably welded, off-site, to a framework of upright beams and floor panels. Interior, dry-walled, panels are preferably attached to the steel frames. Foam insulation is preferably injected into the space between the exterior and interior panels. These components, once assembled, define a prefabricated modular house component which may be assembled off-site in a quality controlled environment. Decorative details such as carpet, light fixtures, decorative borders and wallpaper, cabinets, and electrical outlets may all be installed at the factory. Once completed, the modular house component may be transported to the building site, via truck, where the house component may be easily assembled to the foundation and other modular house components and roof units. Once the foundation has been built, and the modular house component built off-site, the actual house can be assembled on-site within a matter of a few days.

The prefabricated wall and roof units, and accordingly the modular house components, of the present invention may be constructed in an efficient, quality controlled, environment remote from the building site. The modular house components and roof units may then be transported to the building site for efficient installation. The method of the present invention allows for the construction of homes with unique external architectural features while saving costs and without sacrificing quality.

In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAIL DESCRIPTION OF PREFERRED EMBODIMENT(S)

The preferred system herein described is not intended to be exhaustive or to limit the invention to the precise forms disclosed. They are chosen and described to explain the principles of the invention, and the application of the method to practical uses, so that others skilled in the art may practice the invention.

Figure 1:
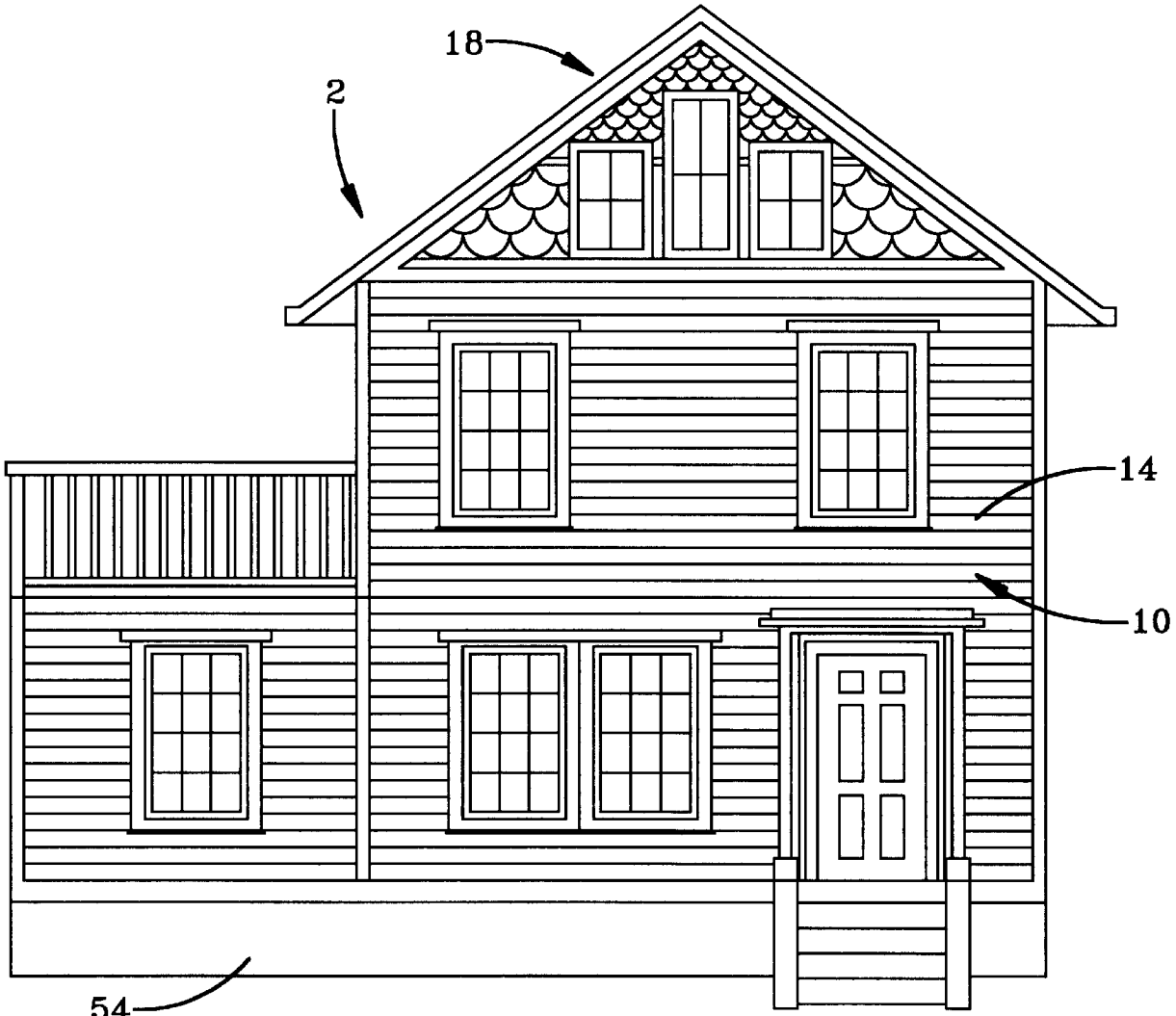
FIG. 1 illustrates a front elevational view of a house of the present invention.

FIG. 1 illustrates one embodiment of a house 2 constructed from a prefabricated wall unit 10 of the present invention. The prefabricated wall unit 10 is comprised of a frame 12, and an exterior panel 14 attached to the frame 12. In the preferred embodiment, the exterior panel 14 is comprised of a molded material which replicates known building features and materials. For example, a mold or plug, of a wood panel wall with antique features may be used to produce wood panel replicates. In another embodiment, a mold depicting a predetermined texture of a roofing material may be used to form external panels 34 of the roofing units 18 of the present invention. Additionally, ornamental architectural features may also be formed integral with the panels 12, 34.

It is preferred that the wall units 10 of the present invention be further comprised of an insulation layer 16 adjacent to the exterior panel 14. In the preferred embodiment, the insulation layer 16 is non-water-based foam material which has been injected into the wall unit 10.

It is preferred that the exterior panel 14 be attached to the frame 12 using an adhesive glue. In the preferred embodiment, the adhesive is a commercially available product called Pliogrip, although there are equivalent products on the market. This adhesive can effectively bond the exterior panel 14 with the steel frame 12. In the preferred embodiment, the external panel 14 is a resin porcelain laminated exterior (for example, a Modar resin or modified acrylic resin). In alternative embodiments, the exterior panel may be made from polymer ceramic composites or fiberglass strands. Exterior panels 14 may be molded from resins and finished with the look of any traditional exterior building materials. The colorization is preferably incorporated into the materials themselves. These exterior panels 14 created with these inert materials are resilient as well as being very resistant to fire. These materials also have excellent environmental advantages over traditional homes as they act to keep the interior air temperature within the home stable with respect to the outside temperature. Additionally, while replicating the look of any building material, such as wood, the molded exterior panel 14 is resistant to termites and other rodents.

Using molded external panels 14 allows the builder to construct the wall and roof units in an off-site factory which utilizes a quality controlled process for increasing the quality of construction of the units. The carpenter preparing the positive for the mold of the exterior panel 14 need only be concerned about quality the first time he makes the positive. Subsequently, external panels 14 formed from the mold have the same quality as the positive which was used to form the mold. This has significant advantages over traditional home making done on-site as the exterior panels 14 of the present invention are made with the similar high quality, from the first panel to the last panel produced, whereas the quality of the on-site house construction depends on the skill of the particular carpenter on a particular given day. Once assembled the wall and roof units may be transported to the building site for easy and cost-efficient installation.

Figure 2:
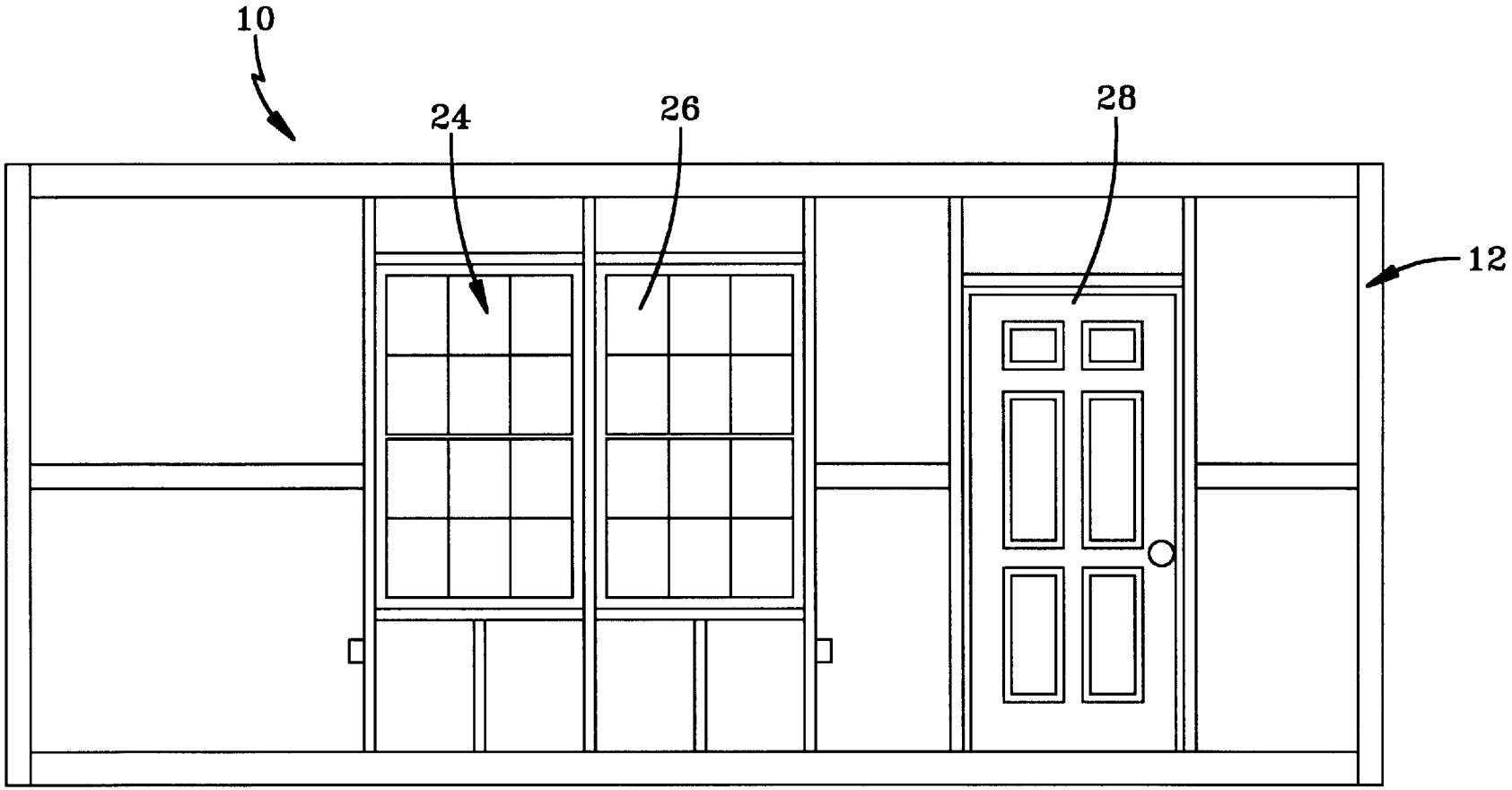
FIG. 2 illustrates a frame of the present invention.

FIG. 2 illustrates a frame 12 of the present invention. The frame 12 of the present invention is preferably made from a steel tubing (however the frame 12 and framework of the present invention can alternatively be made of wood, stone, or other equivalent building material). The exterior panel 14 is adhesively attached, or bonded, to the frame 12 using an adhesive glue. Steel anchors may also be used to anchor the exterior panel 14 to the frame 12. These anchors may be spot-welded to the frame 12 for further support. The steel frame 12 of the present invention contains openings 24 of predetermined size, depending on the size of the windows 26 or doors 28 to be placed in that particular opening 24. These openings 24 can be configured to received any size window 26 or door 28. Unlike traditionally built homes, the windows 26 and doors 28 of the present invention may be directly attached, or hinged, to the frame 12 with an adhesive glue. Traditional homes, built on-site, require additional door or window borders to be built onto the frame requiring additional work and costs. The prefabricated steel frame 12 with predetermined size openings 24 for the fixtures again allows for consistent structural quality and dimensions of each wall unit 10 so the windows 26 and doors 28, which may be standard high quality windows, will fit exactly into the respective openings 24 of the prefabricated steel frames 12. Traditionally built homes do not have these guarantees, even despite higher construction costs, as each frame and each additional window and door border must be built on-site, where there is no stringent quality controlled processes to ensure structural consistency and quality.

Figure 3:
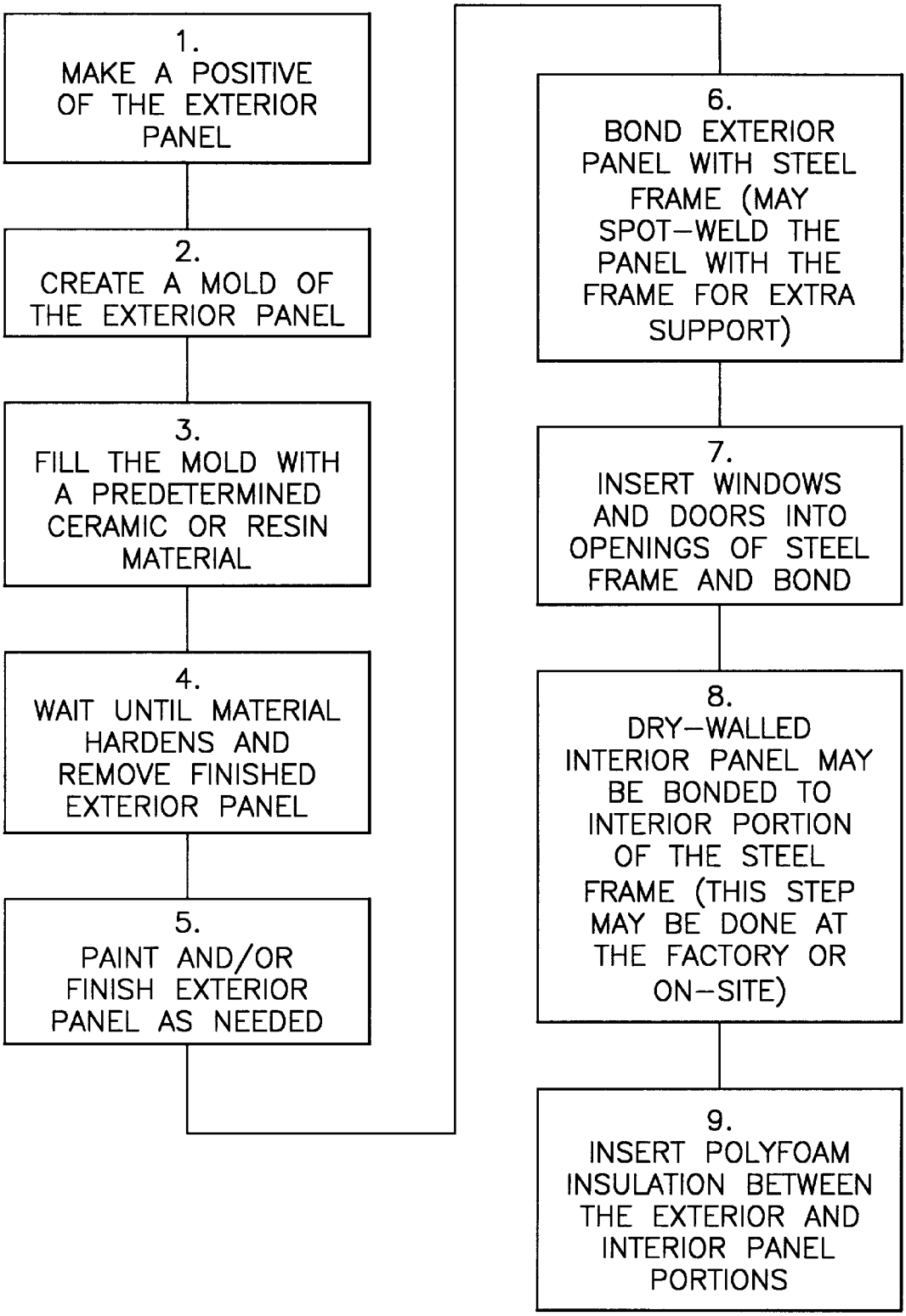
FIG. 3 illustrates a flowchart for producing wall units of the present invention.

FIG. 3 illustrates the process for fabricating the wall units 10 of the present invention. The process for producing the prefabricated wall units 10 and roof units 18 is preferably accomplished by: preparing a plug or mold (discussed in more detail below) of a predetermined building feature; filling the mold with a predetermined material (as discussed above) for preparing a molded exterior panel 14 (the mold may be covered with a layer of wax before filling it to allow easy separation of the hardened molded exterior panel 14 from the mold); removing the molded exterior panel 14 from the mold; and then adhesively attaching, or bonding, the molded exterior panel 14 onto a frame support 12.

The mold is prepared by first constructing a positive of the panel piece. For example, if the constructed house of the present invention is to have brick walls, a positive of a brick wall is first constructed (the size and texture of the bricks used can be varied depending on the tastes of the builder or home buyer). A silicon based mold material is then poured over the positive which is then allowed to cool. Once hardened, the positive is removed from the mold material leaving a mold cavity. Subsequently, any of the materials, or equivalents thereof, discussed above for forming the external panels 14 or roof units 18, may be poured into the mold. Once hardened, the mold is removed from the inserted material leaving a finished external panel piece 14 or roof panel 34. Molds can be created which may replicate any building material. Molds of brick walls, wood walls, stone walls, stucco walls, and any other material can be replicated with the molding process used with the present invention. The external panels 14 created by these molds can be designed to have the look and feel of the building material being replicated. Architectural features such as columns, borders, and even stone statutes may be incorporated into the mold so as to produce decorative external panels 14. These molds can be reused to produce panels 14 over and over having the same consistent quality from the first panel to the last produced. As long as the mold is made properly, every exterior panel 14 formed will have the highest quality and consistency. The panels 14 will fit snugly over the steel frames 12 without undesired variations. Accordingly, centuries old Victorian houses can be economically replicated and reproduced using the mold forming process of the present invention. Decorative borders need only be made once, or even stripped from old houses, to be used as a mold positive for forming exterior panels 14. The versatility of the new home construction process of the present invention is virtually limitless.

Figure 4:
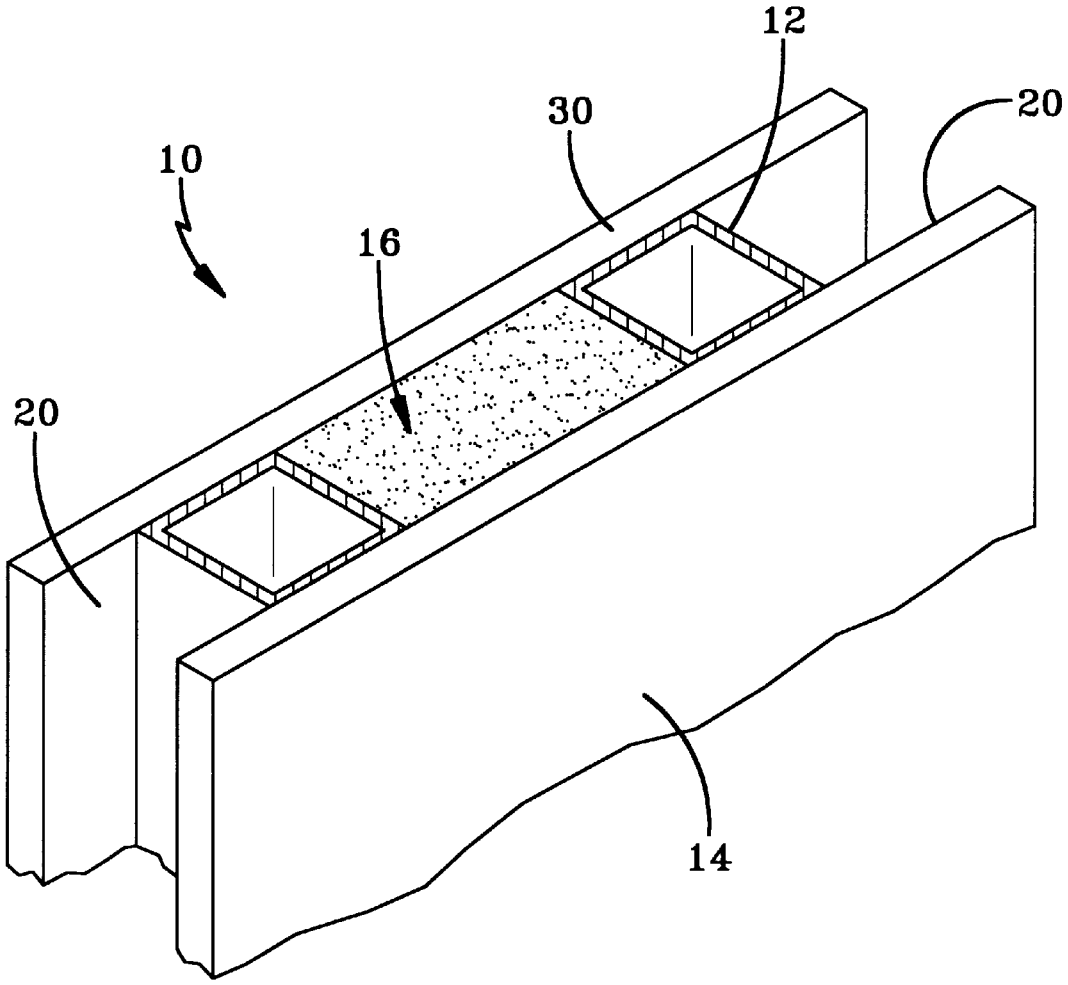
FIG. 4 illustrates a cross-sectional view of the layers of a preferred embodiment of a wall unit of the present invention.

FIG. 4 illustrates a cross-sectional view of the layers of the wall unit 10 of the present invention. An interior panel 30 comprised of a dry-wall construction is bonded to the interior side 20 of the steel frame 12, or on the side opposite the exterior panel 14. The interior panel 30 may be attached to the steel frame 12 at the factory or on-site. The interior panel 30 has all the electrical wiring, phone wiring, fixture and cable outlets built into it. The wiring of the house, established through the chassis of the steel frame 12, corresponds to the outlets contained in the interior wall panel 30. A layer of insulation material may be secured to the inner side 20 of the external panel 14. It is preferred that an insulation foam be injected between the exterior and interior walls panels after they have been bonded to the steel frame 12. The plumbing fixtures and pipes are additionally secured, prefabricated, into the wall unit 10 at the factory site. In another embodiment, certain plumbing fixtures, such as the tub, sink, and toilet, may be molded integrally as part of one of the wall units 10.

Figure 5:
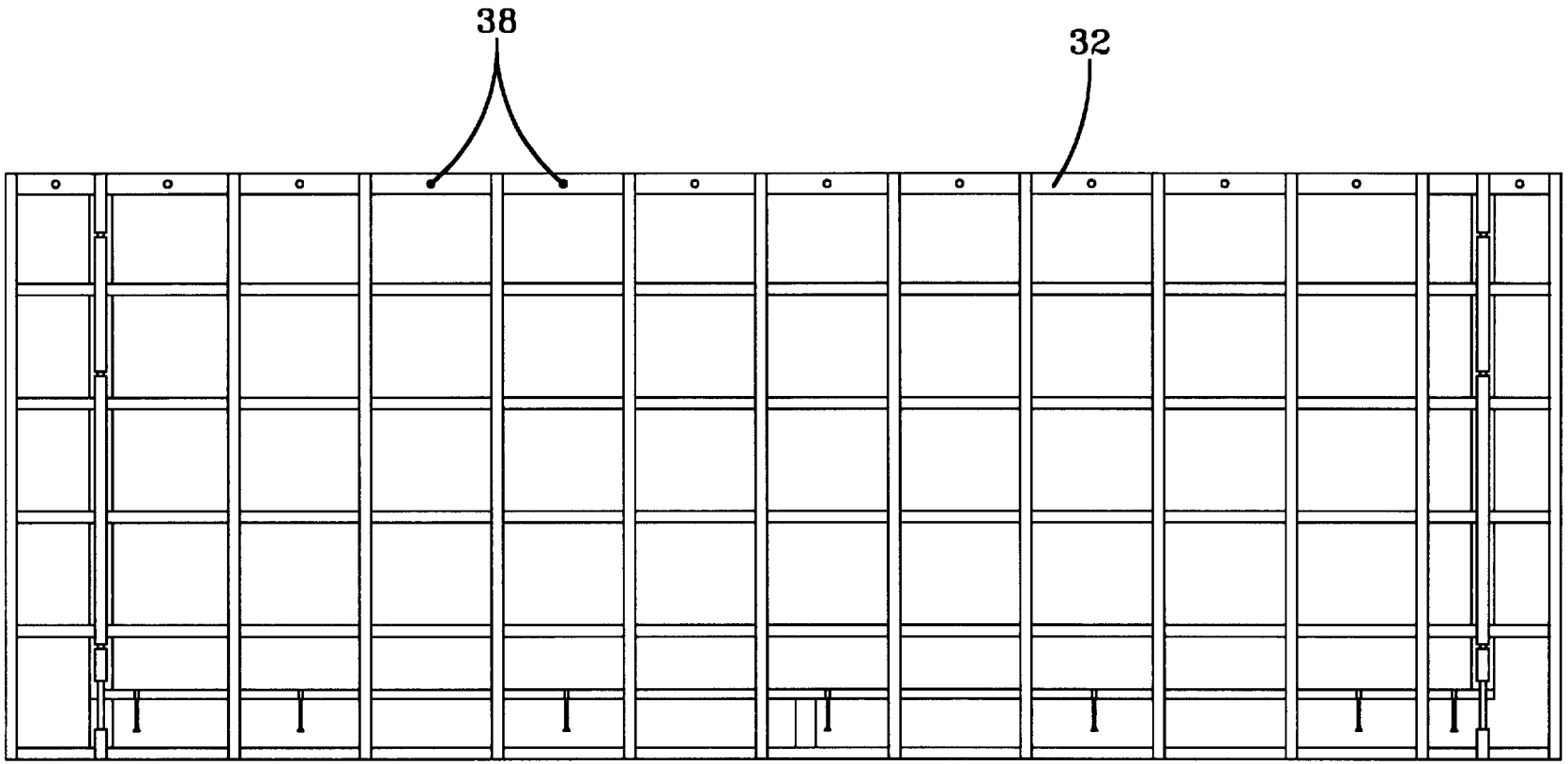
FIG. 5 illustrates a roof frame of the present invention.

FIG. 5 illustrates a frame 32 of a roof unit 18 of the present invention. A prefabricated roof unit 18 may be constructed with the same process as the prefabricated wall unit 10 discussed above. The main difference with the roofs, as opposed to the walls, being the shape of the frame and the roofing molds used for producing the roof units 18 will be different from those used with the wall units 10. Accordingly, the roof unit 18 of the present invention will, preferably, be comprised of: a frame 32 and an exterior panel 34 attached to the frame 32. Similar to the wall units 10, the roof units 18 have exterior panels 34 which are molded to replicate predetermined building materials or roof textiles. These roof units 18 may also be fabricated in an off-site factory, and may be transported to a building site for easy and cost-efficient installation.

Figure 6:
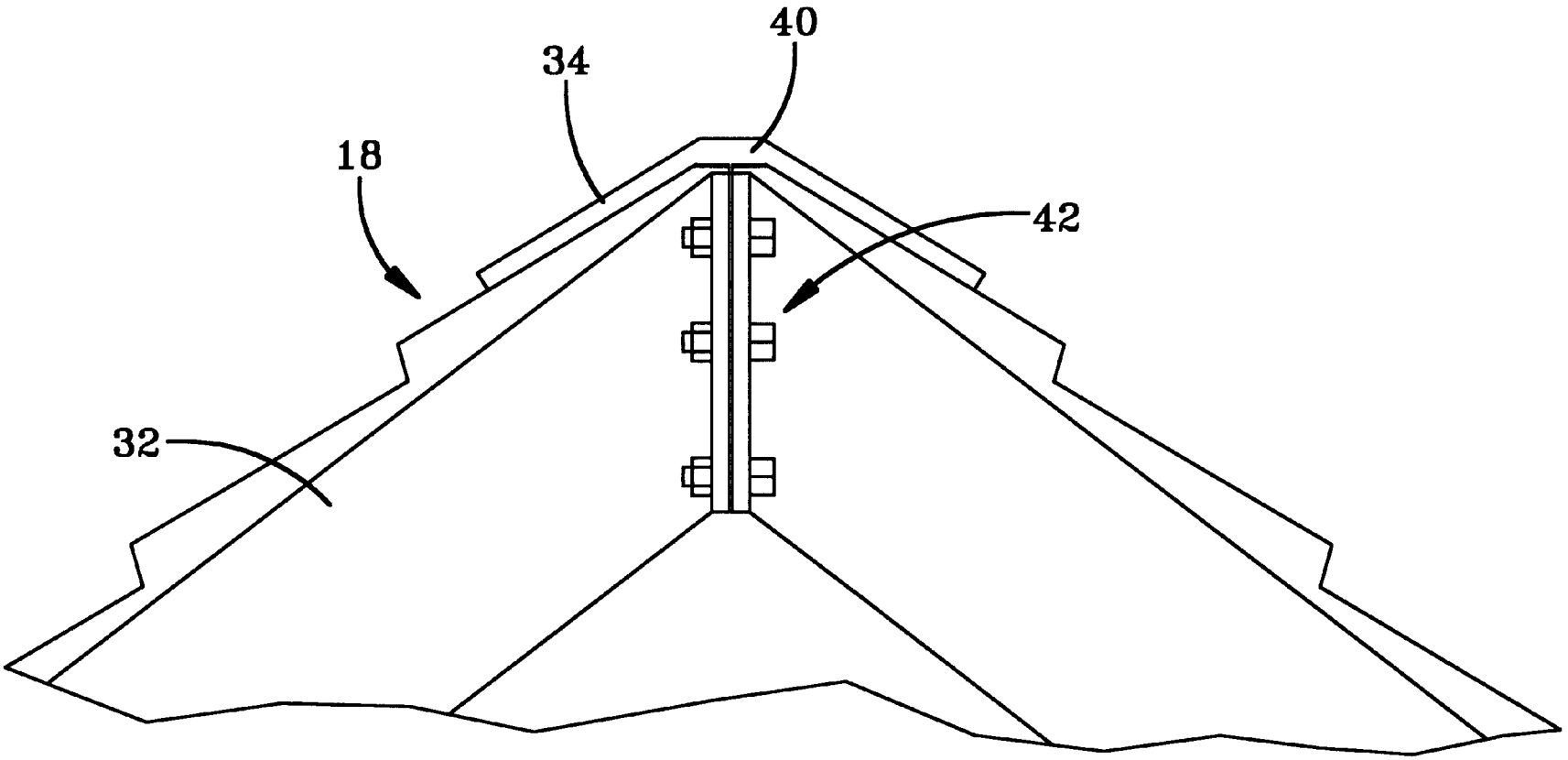
FIG. 6 illustrates an elevational view of assembled roof units of the present invention.

It is preferred that the roof unit 18 have a frame comprised of steel. The roof unit 18 has bolt openings 38 for securing each side of the roof (or roof units 18) together. FIG. 6 illustrates an elevational view of the pinnacle of the roof unit 18. As depicted, the steel frames 32 of the roof units 18 are bolted together 42 at the top of the roof. A ridge cap 40 is inserted into the top of the roof unit 18 so as to plug the gap between the attached steel frames 32.

As discussed above, the wall units 10 and the roof units 18 of the present invention are assembled off-site in quality controlled factory environments. The wall units 10 may also be assembled into more complete modular house components 44 at the off-site factory (on-site meaning the actual home building site).

The modular house component 44 of the present invention is preferably comprised of: a floor panel 46; lateral beams 17; at least two upright beams 48, preferably four, attached to the corners of the floor panel 46; at least one frame 12 (one for each external wall) adhesively attached to the upright beams 48, the frame 12 having a predetermined number of openings 24 for the placement of fixtures such as windows and doors; and an exterior panel 14 adhesively attached to the frame 12, where the exterior panel 14 is molded to replicate a predetermined building material. (Again the frame 12 and exterior panel 14 make up the wall unit 10 of the present invention.) It is preferred that the house component 44 have floor supports 13 (or ceiling supports 15 if it is a top floor component 44). The modular These house components 44 may be attached to each other side-by-side or stacked immediately on top of one another to make a completed house assembly (the assembly discussed in more detail below).

Figure 7:
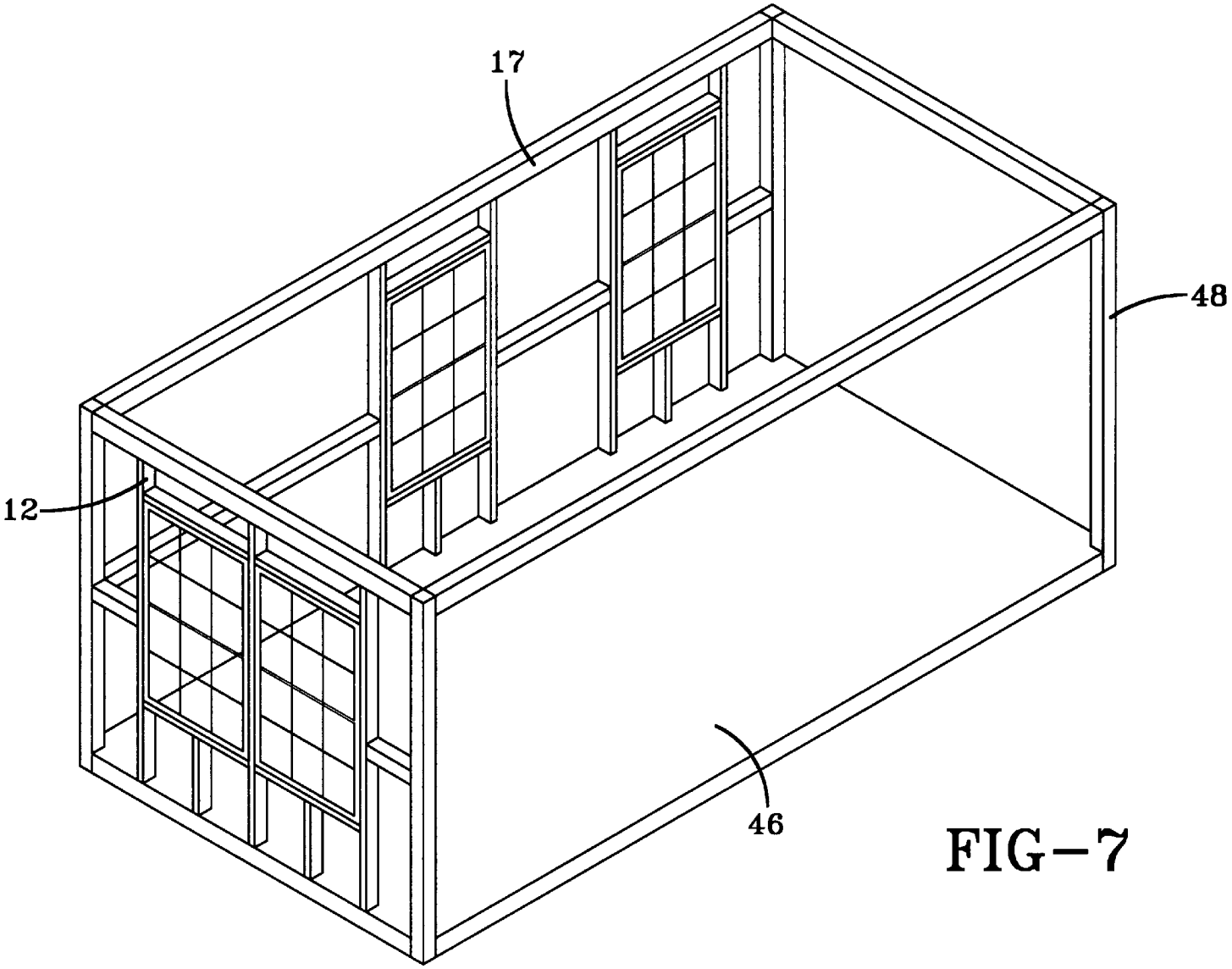
FIG. 7 illustrates the frame of a modular house component of the present invention.
Figure 20:
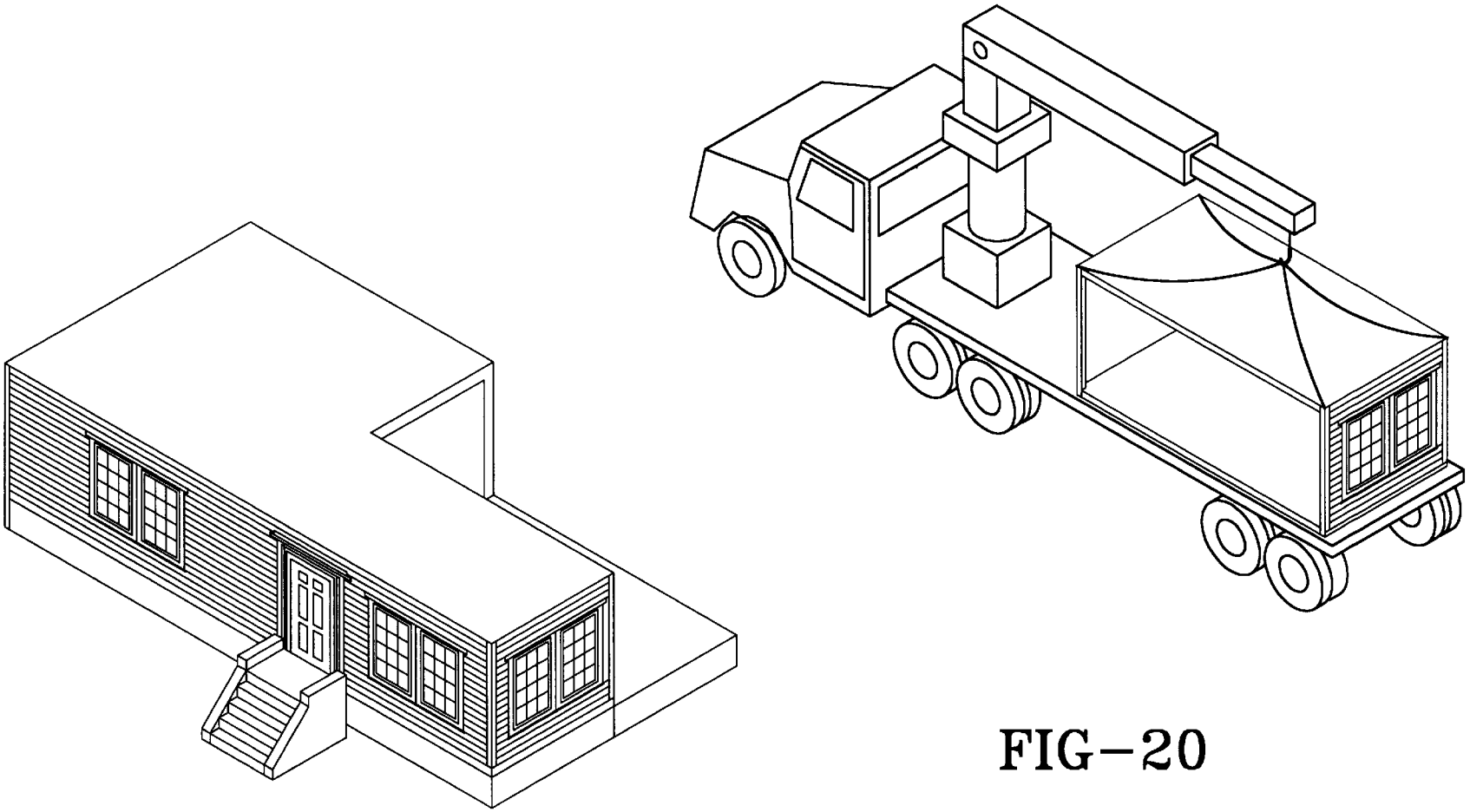
FIG. 20 illustrates how a modular house component may be transported to the building site.
Figure 21:
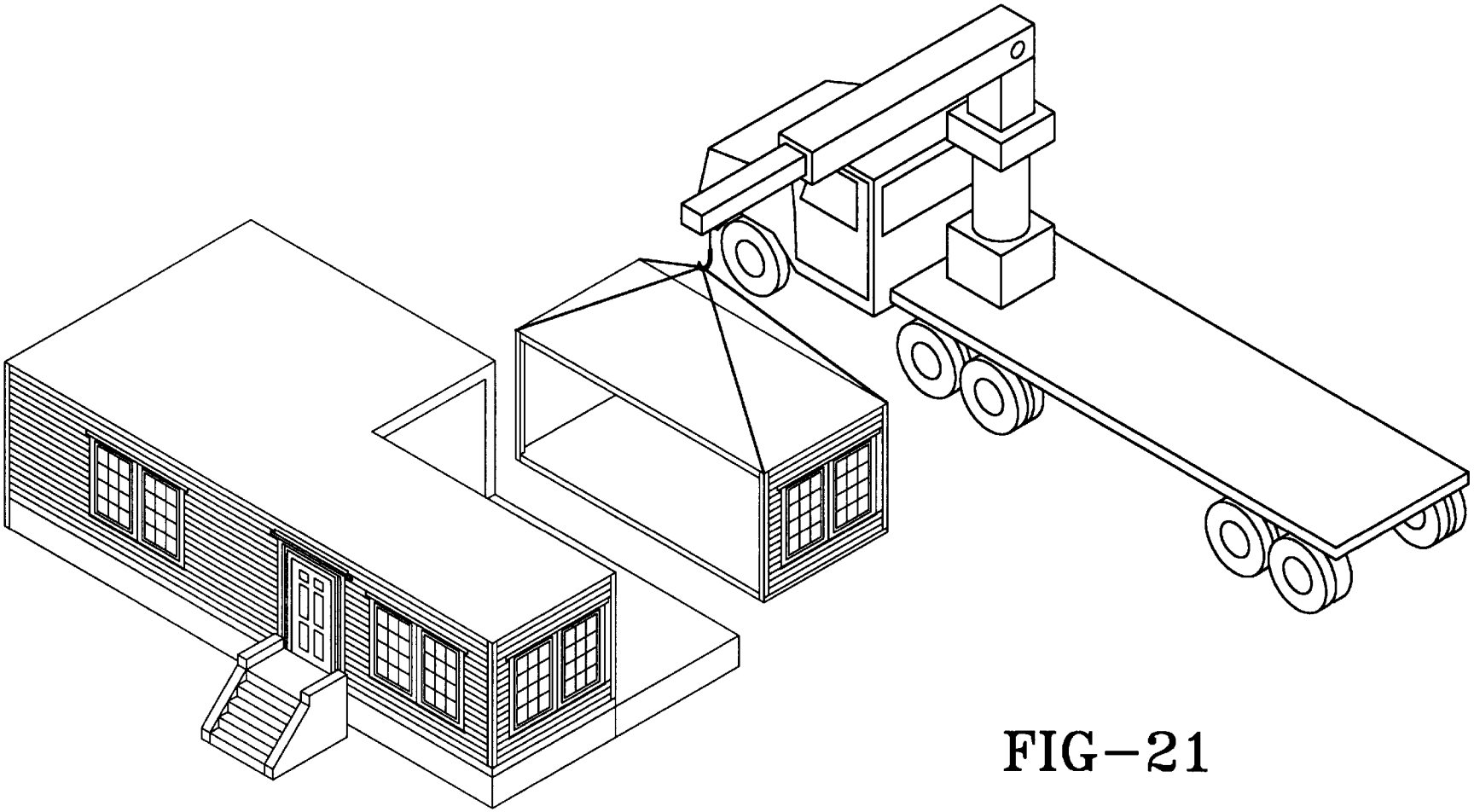
FIG. 21 illustrates how a modular house component may be installed.

FIG. 7 illustrates a stage of construction of a modular house component 44. In FIG. 7 a frame 12 has been attached to the structure formed from the lateral beams 17 and at least two upright beams 48. The exterior panel 14 has not yet been secured to the frame 12 in the modular house component of FIG. 7. (see also FIGS. 20 and 21 illustrating the installment of a modular house component 44).

In the preferred embodiment, the floor panel 46, the lateral beams 17, the frame 12, and the upright beams 48 are comprised of steel. Accordingly, these parts are preferably welded together.

Figure 8:
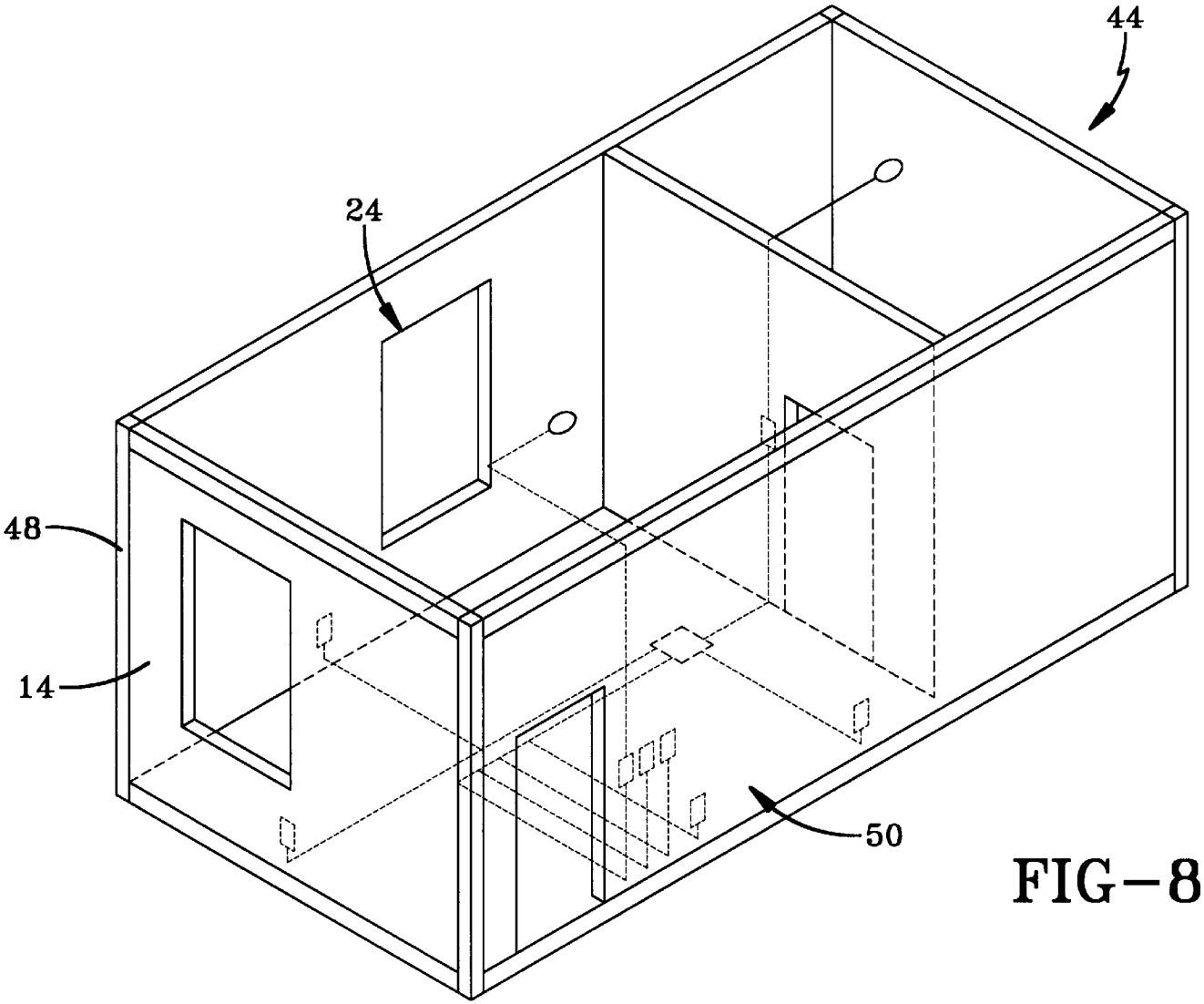
FIG. 8 illustrates a modular house component of the present invention depicting one electrical wiring embodiment.

FIG. 8 illustrates a perspective view of one modular house component 44 depicting an example wiring embodiment, shown generally at 50. Again, the wiring of the house component 44 can be done at the off-site factory. Accordingly, the house component 44 can be transported to the building site completely assembled and ready to be connected to the foundation 52 and other modular house components 44.

Again, in the preferred embodiment, the wall unit 10 of the modular house component 44 has an interior dry-walled panel 30 securably attached to the frame 12. The modular house component 44 may be completely furbished and decorated at the off-site factory. For example, carpet or hardwood floors may be laid over the floor panel 46. Decorative borders, wallpaper, and fixtures may be applied to the interior walls 30. In other words, the house component 44 can be completely manufactured and decorated off-site (similar to a quality controlled automobile factory).

A predetermined number of modular house components 44 may be assembled on-site to an already constructed foundation 52 to form a completely assembled house 2. The number of house components 44, the size, and decorative details of each house component 44 will vary on the style of the house 2 and the specific design preferences of the homeowner. However, in the preferred embodiment the house of the present invention comprises: a foundation 52; at least one prefabricated modular house component 44 securably attached to the foundation 52, the prefabricated modular house component 44 having at least one wall unit 10 having a molded external panel 14 comprised of a predetermined ceramic material; and a prefabricated roof unit 18 for attachment to the prefabricated modular house component 44. The details of the assembly of these separate components will be discussed below.

Figure 9:
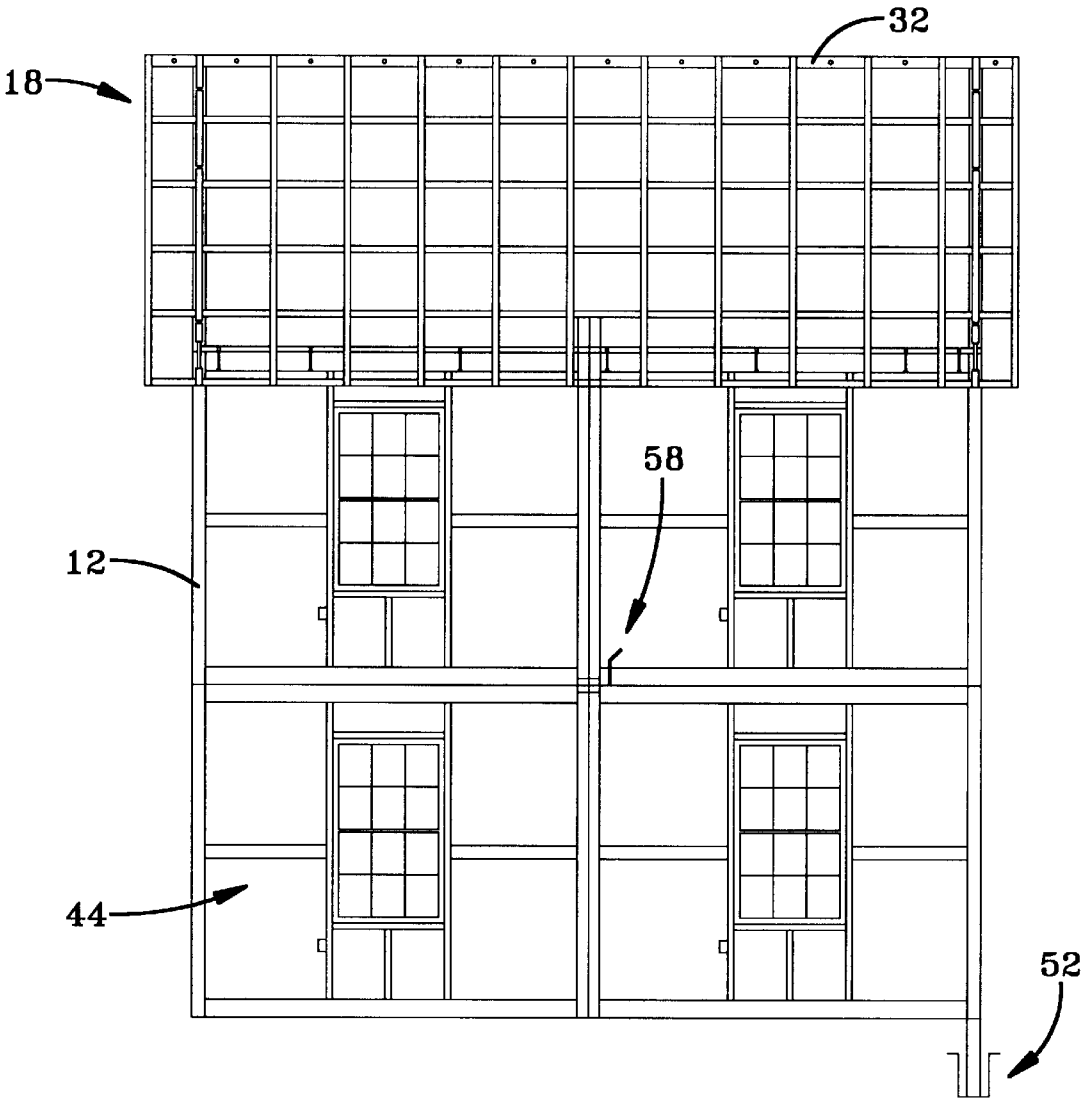
FIG. 9 illustrates an assembled house frame of the present invention.

FIG. 9 illustrates a frame structure of a modular house of the present invention. The external panels have not been depicted in the following figures so as to better illustrate the assembly means of the present invention (or in other words, how the separate house components 44 are attached to each other, the foundation 52, and the roof units 18.)

Figure 10:
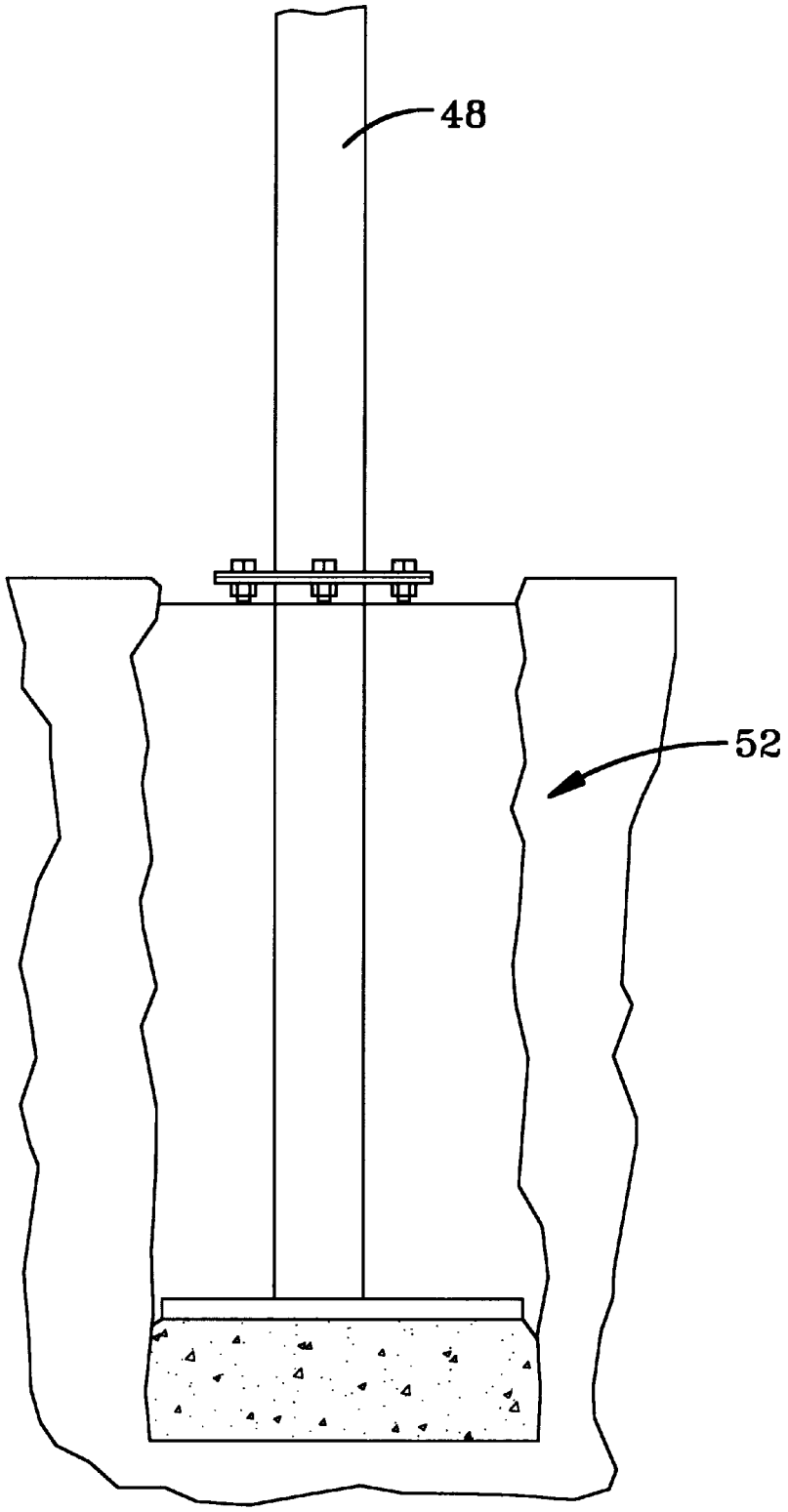
FIG. 10 illustrates a preferred embodiment of a foundation.

Once the modular house components 44 have been delivered to the building site, the first floor modules 44 may be attached to the constructed foundation 52. Industrial cranes are used to hoist the house components 44 into position. FIG. 10 illustrates the preferred foundation 52 and the means to attach the house components 44. As depicted in FIG. 10, it is preferred that the foundation be a pylon-drilled foundation. (A stone skirt 54 can be attached around the foundation once the house 2 has been assembled). The house components 44 may be adjustably bolt to the foundation 52 as depicted in FIG. 10.

Figure 11:
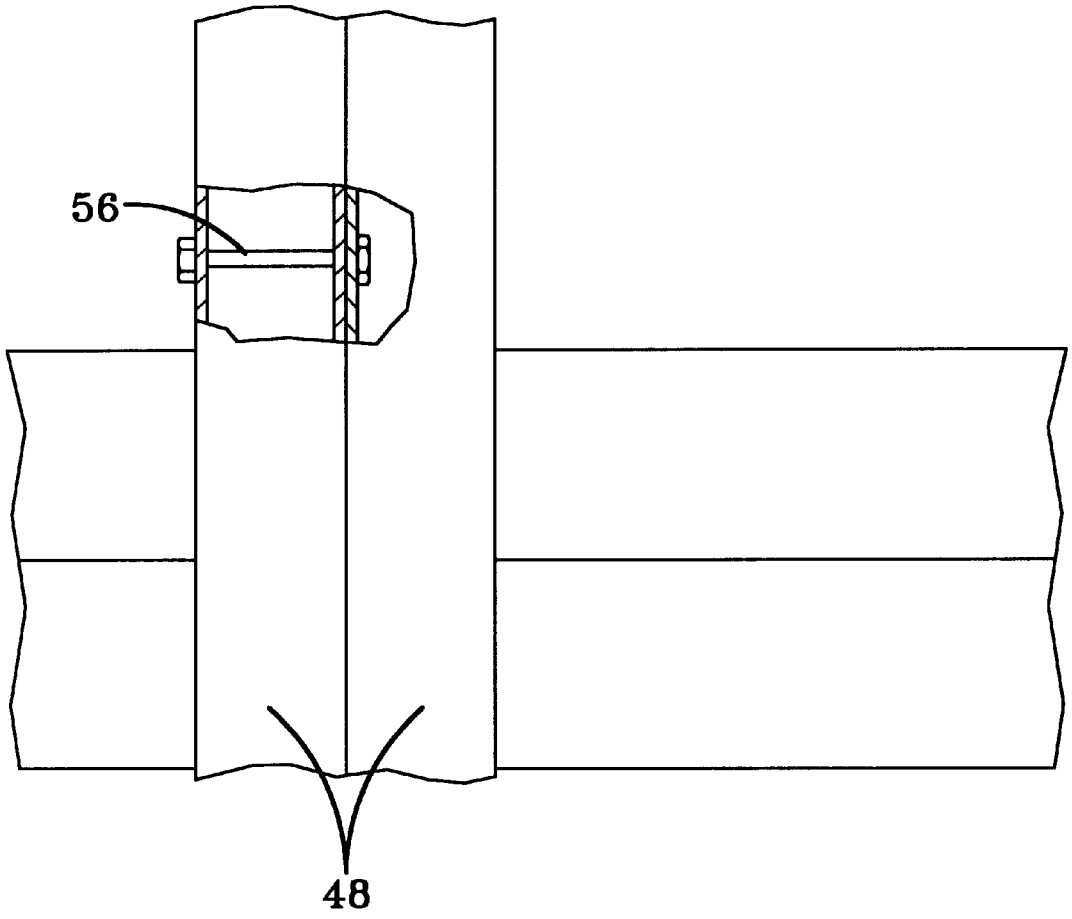
FIG. 11 illustrates the preferred assembly means for adjacent house components of the present invention.

Once the modular components 44 have been attached to the foundation 52 they are preferably secured together. FIG. 11 illustrates the preferred means for securing adjacent house components 44. The bolt 56 in FIG. 11 securably attaches the house components 44 with respect to each other.

Figure 12:
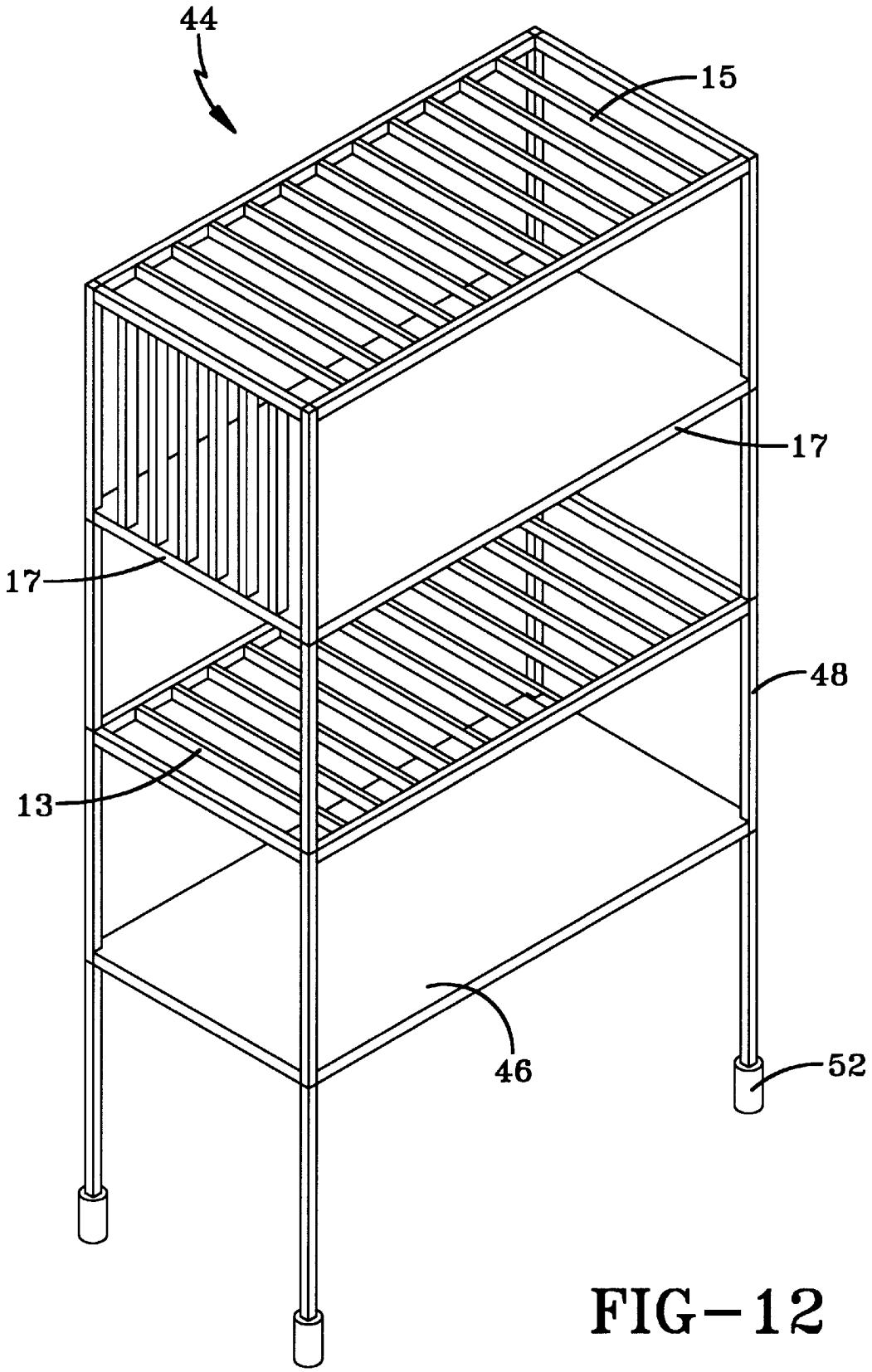
FIG. 12 illustrates the stacking of modular house components of the present invention.

Two separate modular house components 44 can be stacked immediately on top of each other. FIG. 12 illustrates how modular house components are stacked together.

Figure 13:
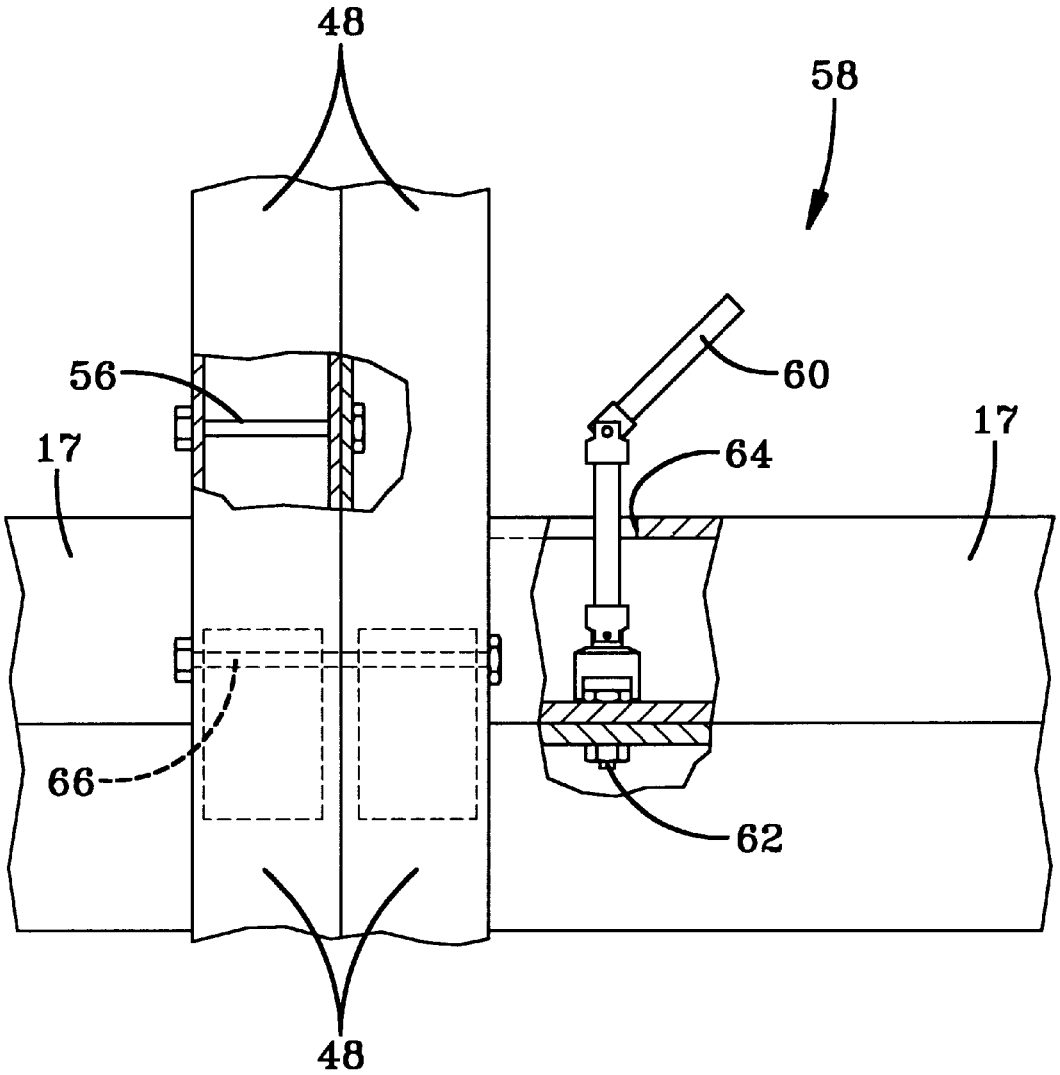
FIG. 13 illustrates a preferred assembly means for a house of the present invention.
Figure 14:
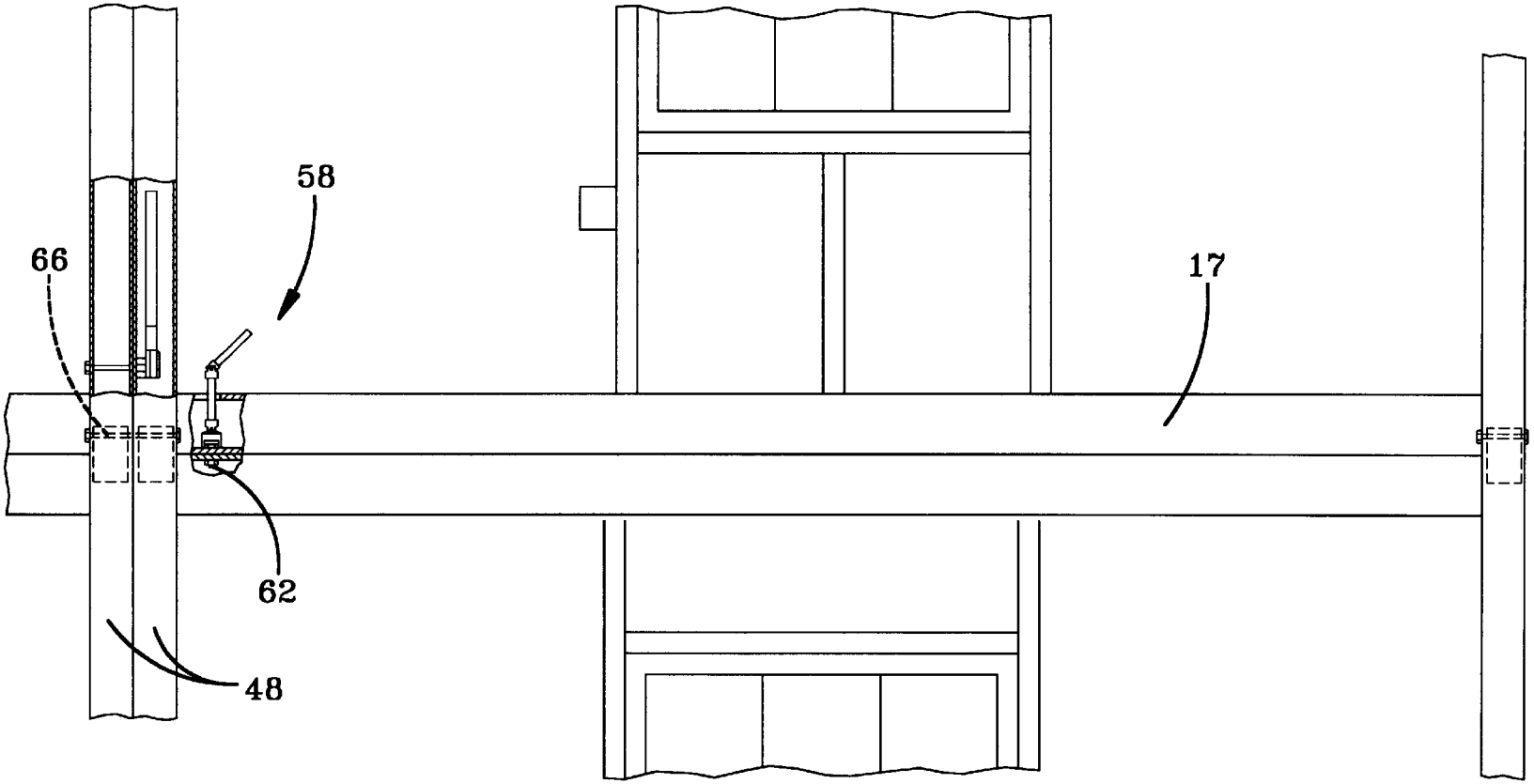
FIG. 14 illustrates another view of the preferred assembly means of the present invention.

Modular house components 44 which have been stacked together are preferably bolted to each other. FIG. 13 illustrates a close-up view of a cross-section of a house assembly of the present invention depicting the bolting means 58. The lateral beams 17 of stacked modular components 44 are preferably bolted together by the bolts 62. FIG. 13 illustrates a wrench 60 inserted through a hole 64 in the lateral beam 17 used to tighten the bolt 62. The upright beams 48 of adjacent modular house components 44 are preferably secured by bolts 56, 66. FIG. 14 illustrates another view of the assembly means of the house 2 of the present invention.

Figure 15:
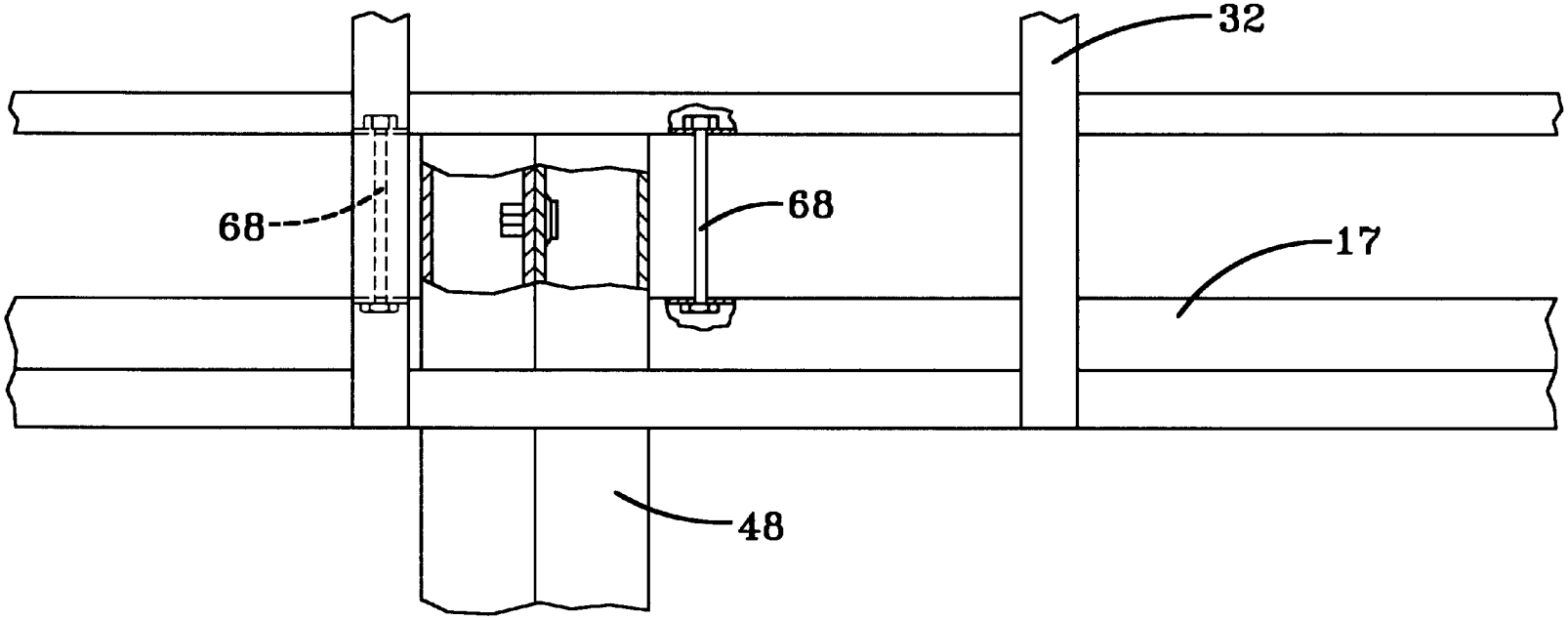
FIG. 15 illustrates another embodiment of an assembly means for the present invention.
Figure 16:
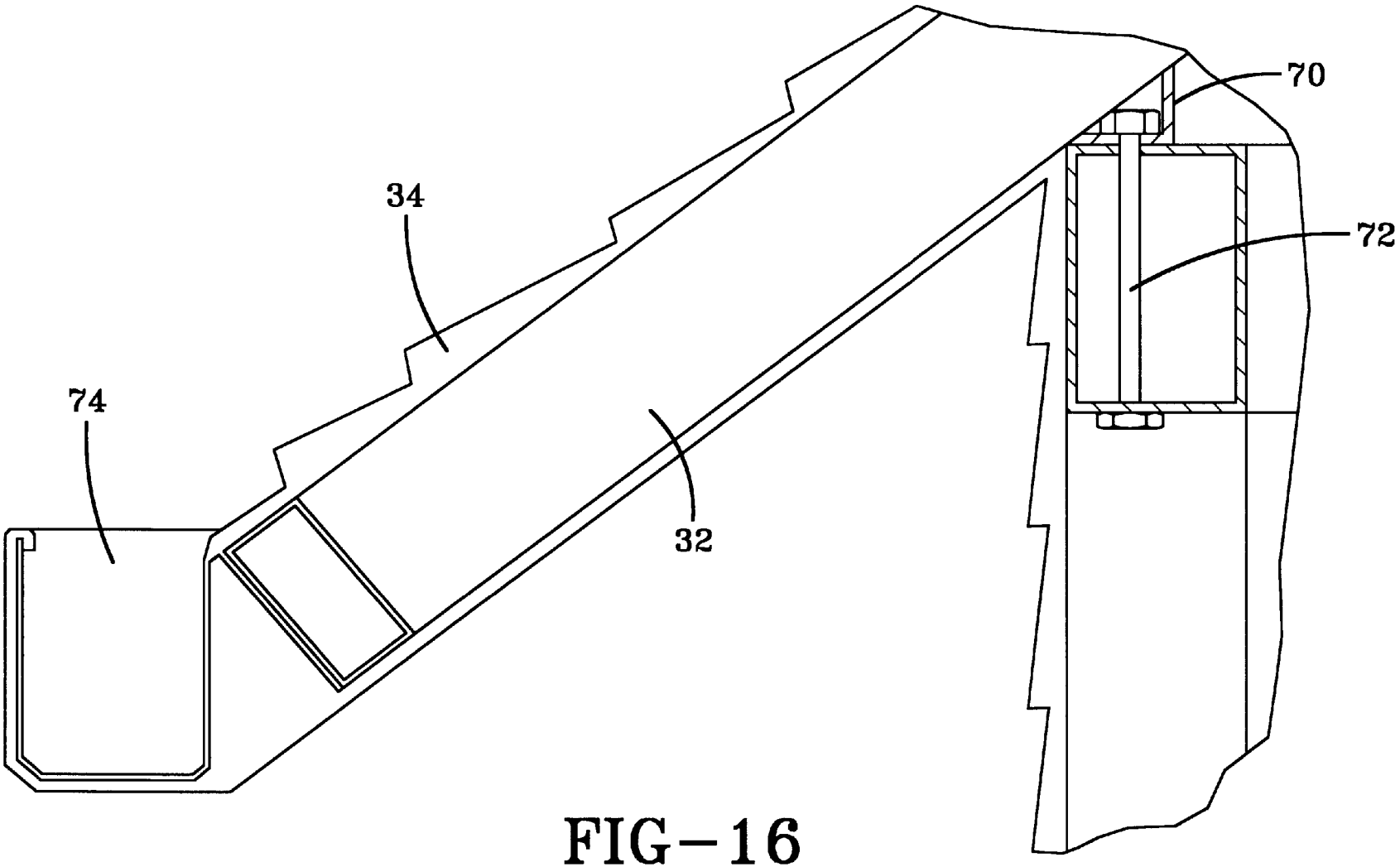
FIG. 16 illustrates one embodiment of the roof assembly means of the present invention.

The roof unit 18 of the present invention is also securably attached to the house components 44 by a bolt construction. The frame 32 of the roof unit 18 is bolted to the lateral beam 17 of the top-most modular house components 44 by bolts 68 (see FIG. 15). It is also preferred that the roof frame 32 have mounts 70 for accepting bolts 72 from the corner uprights 48. FIG. 16 also illustrates a drainage gutter 74 which has been molded as part of the exterior panel 34. This one piece construction is beneficial as drainage gutters have been known to easily become damaged and easily detached from the house structure. The preferred steel frame assembly as described above results in a sturdy house which can withstand much greater loads than traditionally built homes.

Figure 17:
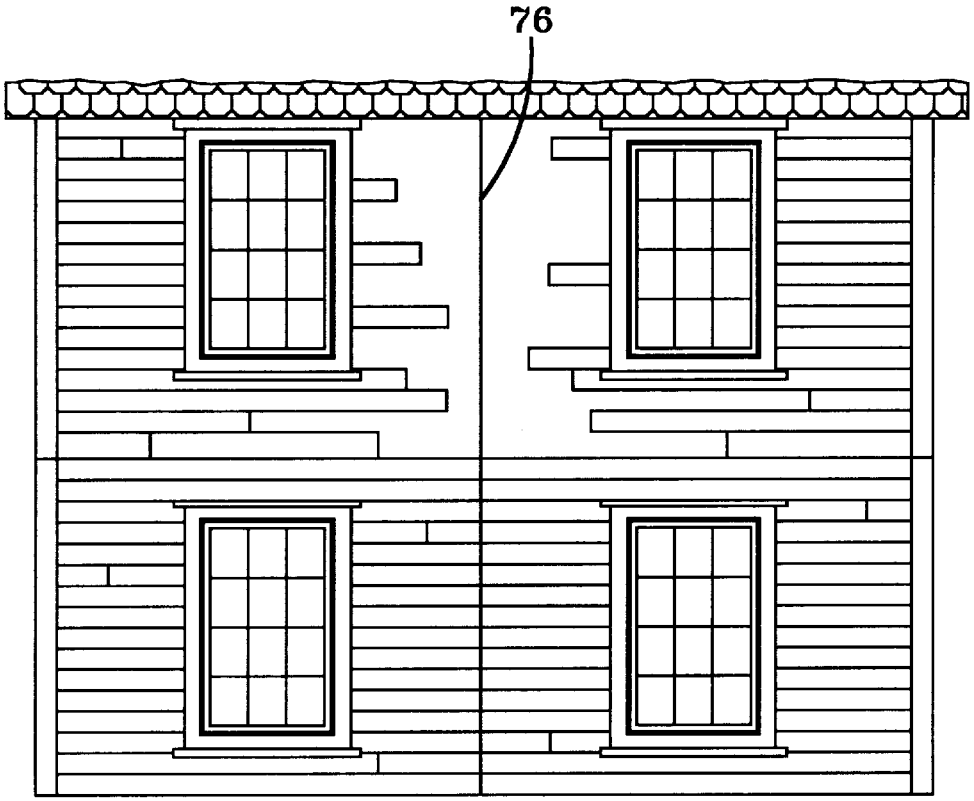
FIG. 17 illustrates an elevational view of a exterior panel of the present invention.
Figure 18:
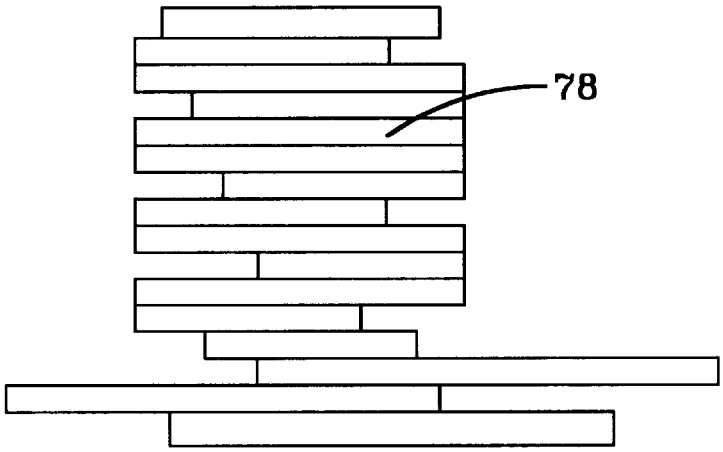
FIG. 18 illustrates a plan view of a connection-line covering panel of the present invention.
Figure 19:
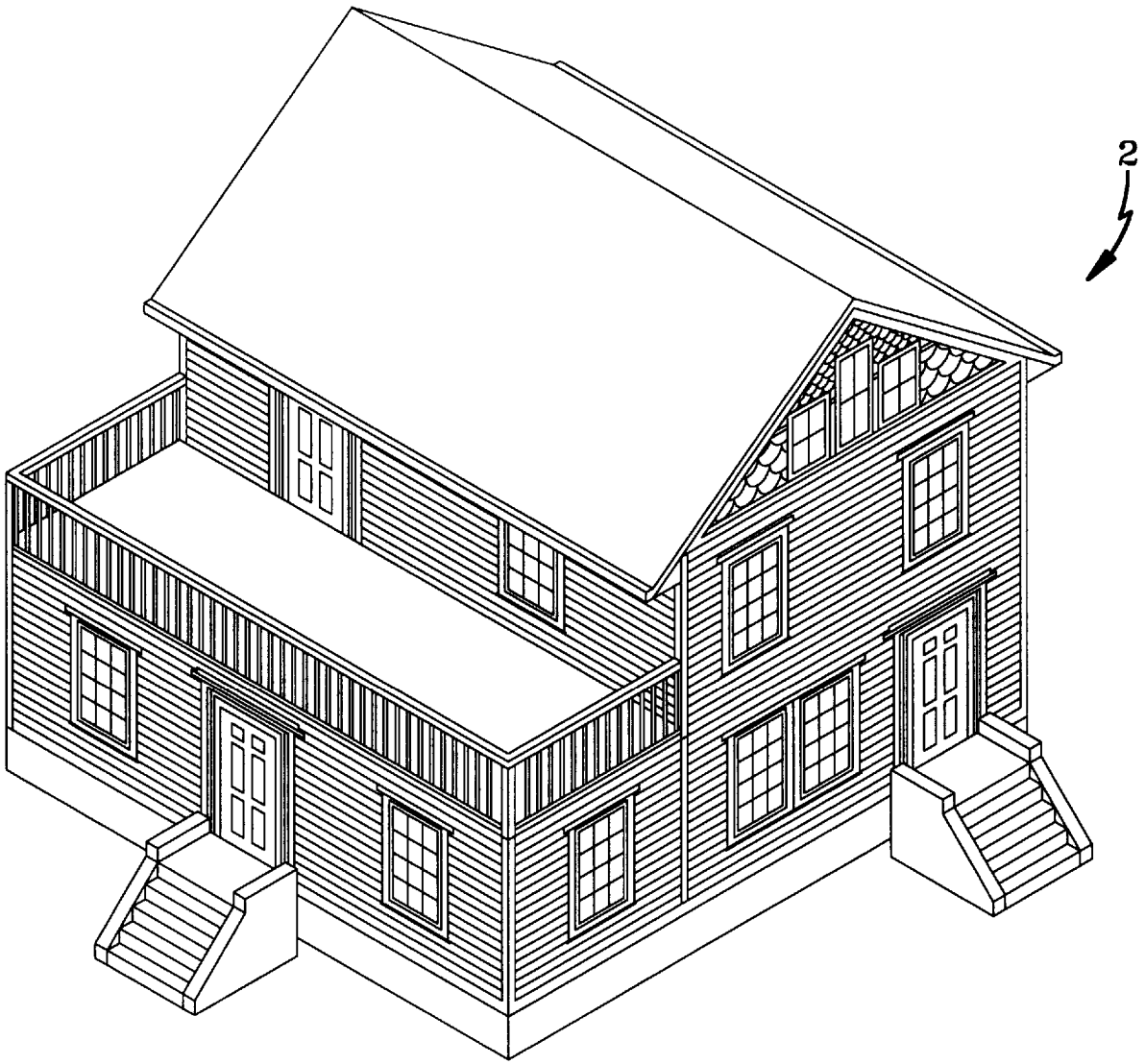
FIG. 19 illustrates a house of the present invention.

FIGS. 17 and 18 illustrate a means for hiding the connection lines 76 between adjacent modular house components 44. A separate panel piece 78 may be form-fitted over the connection line 76. FIG. 19 illustrates one embodiment of a completed house 2 constructed from modular house units 44 of the present invention. Houses 2 such as the one depicted in FIG. 19 may be assembled on-site within a few days without sacrificing quality while lowering construction costs.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A modular house component, comprising:

a floor panel;

at least two upright beams attached to adjacent corners of said floor panel;

a frame attached to said upright beams, said frame having predetermined openings for the placement of fixtures;

an exterior panel adhesively attached to said frame, wherein said exterior panel is a ceramic composite panel form-molded to replicate a predetermined building material; and wherein said modular house component is prefabricated and adapted to be transported to a building site and attached to a plurality of other modular house components to form a house.

2. A modular house component according to claim 1, wherein said floor panel, said frame, and said upright beams are comprised of steel and wherein said floor panel and said upright beams are welded together; and wherein said modular house component is adapted to be secured to a second modular house component.

3. A modular house component according to claim 2, further comprising:

at least one window adhesively attached in one of said predetermined openings for the placement of fixtures.

4. A modular house component according to claim 1, wherein said frame is pre-wired with electrical and phone lines.

5. A modular house component according to claim 1, further comprising:

an interior dry-walled panel securably attached to said frame.

6. A modular house component according to claim 5, further comprising:

foam insulation injected between said exterior and interior panels.

7. A modular house component according to claim 1, further comprising:

a layer of carpet covering said floor panel.

8. A modular house component according to claim 1, further comprising:

lateral beams attached to said upright beams.

9. A modular house component according to claim 8, further comprising:

a floor support attached to said lateral beams.

10. A modular house component according to claim 8, further comprising:

a ceiling support attached to said lateral beams.

11. A modular house component according to claim 1, wherein said exterior panel is a solitary panel that is attached to said frame to form an entire exterior panel of said modular house component and wherein said solitary panel is form-molded to replicate a panel of predetermined building material.

12. A modular house component according to claim 1, wherein said ceramic exterior panel is formed-molded to replicate a wood-siding panel.

13. A modular house comprised of a plurality of modular house components according to claim 1, wherein said plurality of modular house components are bolted together.

14. A modular house component, comprising:

a floor panel;

at least two upright beams attached to adjacent corners of said floor panel;

an exterior panel adhesively attached to said upright beams, wherein said exterior panel is form-molded from a predetermined material selected from the group consisting of ceramic composites, laminate resin composites, or fiberglass composites or a combination thereof, said exterior panels form-molded to replicate a predetermined building material; and wherein said modular house component is prefabricated and adapted to be transported to a building site and attached to a plurality of other modular house components to form a house.

15. A modular house component according to claim 14, wherein said exterior panel is a solitary panel that is attached to said upright beams to form an entire exterior panel of said modular house component and wherein said solitary panel is form-molded to replicate a panel of predetermined building material.

16. A modular house component according to claim 15, wherein said exterior panel is form-molded to replicate a predetermined building material chosen from the group consisting of brick, wood or stucco.

* * * * *